United States Patent [19]

Hartley et al.

[11] Patent Number: 4,797,069

[45] Date of Patent: Jan. 10, 1989

[54] PUMP WITH VARIABLE ANGLE WOBBLE PLATE

[75] Inventors: E. Dale Hartley, Malibu; F. Scott Hartley, Camarillo, both of Calif.

[73] Assignee: Product Research And Development, Anaheim, Calif.

[21] Appl. No.: 57,808

[22] Filed: Jun. 3, 1987

[51] Int. Cl.[4] ..... F04B 1/28; F01B 3/00

[52] U.S. Cl. ..... 417/222; 91/475; 92/12.2

[58] Field of Search ..... 92/12.2; 417/222, 221; 91/475

[56] References Cited

U.S. PATENT DOCUMENTS

| | | | |
|---|---|---|---|
| 1,982,958 | 12/1934 | Kraus | 417/221 |
| 2,016,802 | 10/1935 | Fick | 91/475 |
| 2,573,863 | 11/1951 | Mitchell | 417/270 |
| 2,680,412 | 6/1954 | Entwistle | 417/221 |
| 2,926,735 | 3/1960 | Cook | 92/12.2 |
| 3,010,339 | 11/1961 | Brock | 92/12.2 |
| 3,010,403 | 11/1961 | Zubaty | 417/269 |
| 3,304,886 | 2/1967 | Roberts | 417/222 |
| 3,973,471 | 8/1976 | Hirmann | 92/12.2 |
| 4,153,391 | 5/1979 | Hartley . | |
| 4,396,357 | 8/1983 | Hartley . | |
| 4,507,058 | 3/1985 | Schoenmeyr | 417/270 |

FOREIGN PATENT DOCUMENTS

| | | | |
|---|---|---|---|
| 65938 | 12/1982 | European Pat. Off. | 417/269 |
| 496665 | 3/1930 | Fed. Rep. of Germany | 417/269 |
| 932763 | 8/1955 | Fed. Rep. of Germany | 417/269 |
| 21043 | 4/1956 | Fed. Rep. of Germany | 417/269 |
| 909185 | 5/1946 | France | 92/12.2 |
| 585940 | 11/1958 | Italy | 417/270 |
| 468122 | 6/1937 | United Kingdom | 417/270 |

*Primary Examiner*—William L. Freeh

*Attorney, Agent, or Firm*—Gordon L. Peterson

[57] ABSTRACT

An apparatus for moving a fluid medium comprising a positive displacement member movable to move the fluid medium and a drive mechanism adapted to be driven by a motor for driving the positive displacement member to move the fluid medium. The drive mechanism includes a driving member, a driven member, a resilient coupling and a wobble plate for driving the positive displacement member. The angle of the wobble plate is adjustable by varying the relative angular position of a driving member and a driven member.

14 Claims, 3 Drawing Sheets

PUMP WITH VARIABLE ANGLE WOBBLE PLATE

BACKGROUND OF THE INVENTION

Positive displacement pumps, such as piston pumps and diaphragm pumps, typically displace an essentially constant volume of liquid with each stroke of the positive displacement pumping member. Pumps of this type are very useful for many applications, and a typical positive displacement pump is shown by way of example in Hartley U.S. Pat. No. 4,153,391.

For some applications and under some operating conditions, the characteristic of positive displacement pumps which causes them to displace a constant volume of liquid per stroke is undesirable. For example, when a positive displacement pump is used to supply a liquid for which there is a low demand relative to the output of the pump, the pump must operate under substantial back pressure unless some means is provided to correct this condition. A high back pressure tends to provide a heavy load on the motor which drives the pump.

One way to attempt to correct this is to cycle the pump on and off in response to demand as is commonly done in water supply systems for recreational vehicles. However, this technique is noisy and requires maximum current draw each time the pump is run. In addition, on-off cycling causes some variation in flow rate as the pressure changes between the pressure limits required to cycle the pump. This is particularly undesirable when the pump is used in beverage dispensing systems.

An effective way of varying the output from a positive displacement pump is to drive the pump with a wobble plate drive and to vary the angle of the wobble plate. One such construction is shown in Schoenmeyr U.S. Pat. No. 4,507,058, and the contents of this patent are incorporated by reference herein. In the construction shown in this patent, a coupler is rocked about a drive shaft against the biasing action of a resilient member to achieve variation in the wobble plate angle. Although this technique is desirable, for some applications, it is difficult to obtain sufficient force from the resilient member to transmit the desired torque.

SUMMARY OF THE INVENTION

This invention provides a novel and advantageous construction for varying the angle of a wobble plate. This invention is applicable to wobble plate drives in general and to devices, such as positive displacement pumps and compressors, which employ a wobble plate drive mechanism.

An apparatus in accordance with this invention may include a rotatable driving member adapted to be driven by a motor and a rotatable driven member mounted on the driving member for rotation relative to the driving member so as to vary the relative angular position of the driving and driven members. A resilient torque transmitting coupling couples the driving member to the driven member so that rotation of the driving member drives the driven member. However, because the coupling is resilient, it deforms resiliently in response to the transmission of torque of a predetermined magnitude to thereby change the relative angular position of the driving and driven members. Thus, the relative angular positions of the driving and driven members are related to the torque transmitted by the torque transmitting coupling.

With this invention, the angle of the wobble plate is adjusted as a function of the relative angular position of the driving and driven members. Accordingly, if the wobble plate is used to drive an apparatus for moving a fluid medium, such as a positive displacement pump, the output of the pump is tailored to the torque transmitted by the wobble plate drive mechanism. In actual practice, the torque transmitted is primarily a function of back pressure from the pump, and so this construction enables the output of the pump to be varied in accordance with the back pressure on the pump or other fluid medium moving apparatus.

The use of the resilient torque transmitting coupling between the driving and driven members enables the wobble plate drive mechanism to respond automatically and immediately to changes in transmitted torque and back pressure. The stiffness or spring rate of the torque transmitting coupling controls the magnitude of wobble plate angle change that will occur in response to a given change in transmitted torque. By preloading the resilient torque transmitting coupling, the drive mechanism will transmit torque up to a predetermined limit corresponding to the preload before any wobble plate angle change will occur.

With this invention, torque is transmitted from the driving member through the resilient torque transmitting coupling to the driven member. With this construction, the resilient coupling can be of ample stiffness to transmit the desired level of torque thereby eliminating one of the problems with the prior art.

Although the use of a resilient torque transmitting coupling between the driving and driven members is preferred, the relative angular position of the rotatable driving and driven members can be adjusted in other ways, if desired. For example, the relative angular positions of the driving and driven members may be adjusted by employing a polygonal shaft and a bore of corresponding configuration that will allow indexing of the driven member to various different angular positions relative to the driving member. Of course, this construction does not permit the automatic variation in wobble plate angle as a function of transmitted torque or back pressure.

With this invention, means is provided on the driving and driven members for adjusting the angle of the wobble plate as a function of the relative angular position of the driving and driven members. This can be accomplished, for example, by mounting the driven member on the driving member for rotation about a first inclined axis which is inclined relative to the rotational axis of the drive member. The wobble plate is mounted on the driven member for rotation about a second inclined axis which is inclined relative to the first inclined axis.

With this construction, in one angular position of the driving and driven members, the angular offsets provided by the two inclined axes are added together to form a maximum angular offset and, hence, a maximum wobble plate angle. At a position displaced 180 degrees from this position, the angular offset provided by the two inclined axes is subtracted from each other to provide a minimum angular offset and a minimum wobble plate angle. If the angular offsets provided by the two inclined axes are equal, then at this latter position, the minimum offset angle, and hence the wobble plate angle, is 0. For positions intermediate these two extremes, intermediate wobble plate angles are obtained.

If desired, the driving and driven members can be arranged so that less than the maximum wobble plate angle is obtained at the beginning of pump operation.

This provides a quicker shutdown in response to increased back pressure. However, this also reduces the maximum wobble plate angle and, hence, maximum displacement of the pump or other positive displacement apparatus.

The invention, together with additional features and advantages thereof, may best be understood by reference to the following description taken in connection with the accompanying illustrative drawings.

DESCRIPTION OF THE PREFERRED EMBODIMENT

Figure 1:
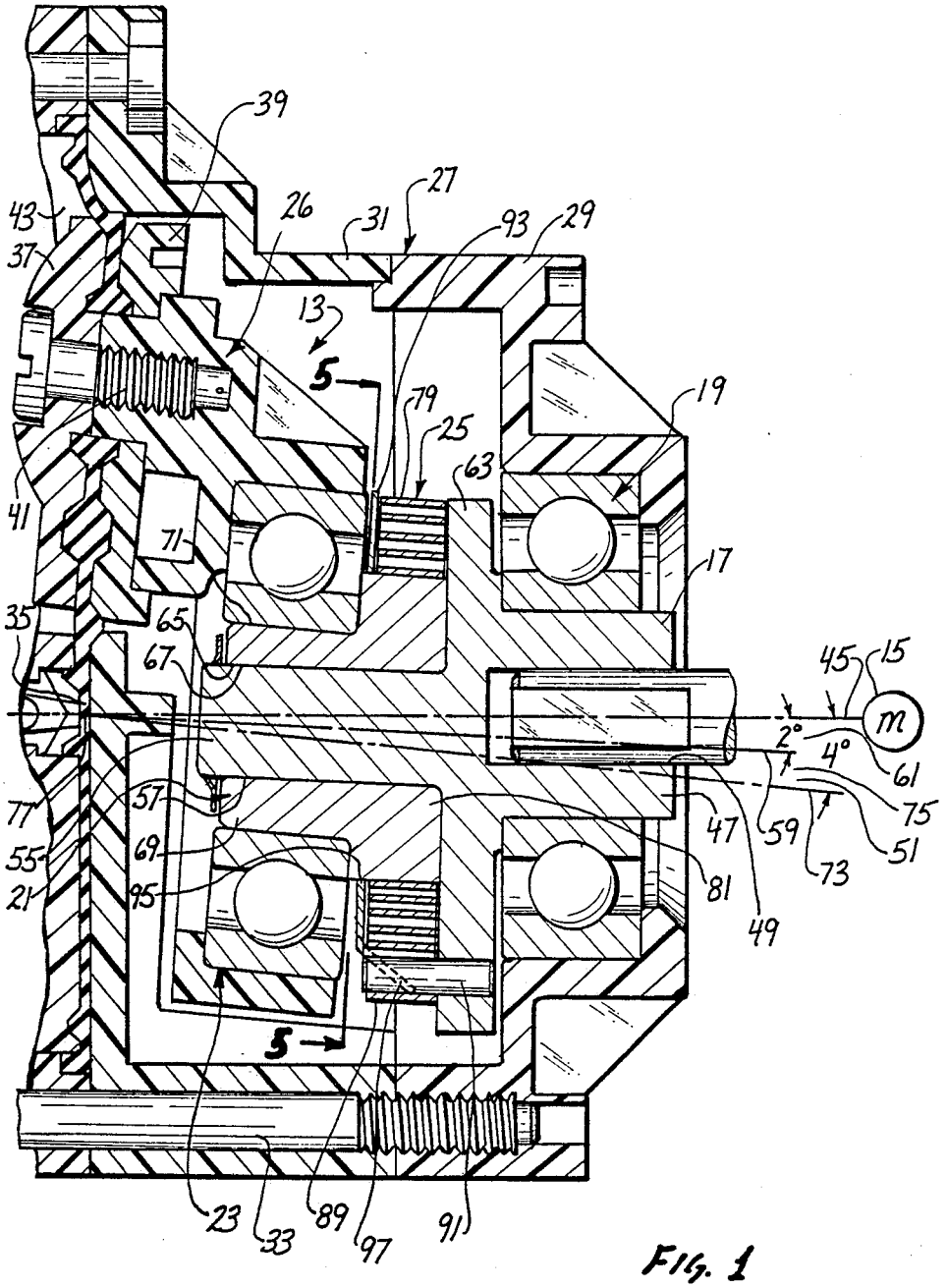
FIG. 1 is a longitudinal sectional view through a positive displacement pump having a wobble plate drive constructed in accordance with the teachings of this invention. Portions of the pump are shown schematically.

FIG. 1 shows a pump 11 having incorporated therein a wobble plate drive mechanism 13. The drive mechanism 13 can be employed with pumps other than the pump 11 and with other devices where variation in wobble plate angle is desirable. The pump 11 is driven by an electric motor 15, and power from the motor is transmitted to the pump via the drive mechanism 13. Generally, the drive mechanism 13 includes a driving member 17, a ball bearing 19, a driven member 21, a ball bearing 23, a torque transmitting coupling 25 and a wobble plate 26.

The pump 11 may be a piston pump, or it may be, for example, a diaphragm pump of the type shown in Hartley U.S. Pat. No. 4,153,391 or Schoenmeyr U.S. Pat. No. 4,507,058, and both of these patents are incorporated by reference herein. Because the pump 11 or other apparatus for moving a fluid medium is not novel per se, it is not shown in detail herein.

In the embodiment illustrated, the pump 11 includes a housing 27 comprising housing sections 29 and 31 of molded plastic material suitably held together as by screws 33 (only one being shown). The pump 11 also includes a diaphragm 35 of flexible material clamped between clamping members 37 and 39 which are in turn held together by a threaded fastener 41. The clamped region of the diaphragm 35 and adjacent diaphragm regions cooperate with other portions of the pump 11 to form a pumping chamber 43, with the applicable region of the diaphragm serving as a positive displacement pumping member. Other regions of the diaphragm 35 may be similarly clamped between identical clamping members for use in forming additional pumping chambers as shown in the Hartley and Schoenmeyr patents referred to above.

The wobble plate drive mechanism 13 drives the regions of the diaphragm 35 that are used in the formation of the pumping chambers 43. For this purpose, the ball bearing 19 is suitably retained within the housing 27 and mounts the driving member 17 for rotation about a rotational axis 45. More specifically, the driving member 17 has a cylindrical hub 47 which is pressed into the ball bearing 19 for rotation with the inner race of the bearing. The hub 47 has a bore 49 for receiving a drive shaft 51 of the motor 15. The bore 49 and the drive shaft 51 are cylindrical, except for mating flats 53 (only the flat 53 of the drive shaft 51 is shown in FIG. 1) whereby the drive shaft 51 is drivingly coupled to the driving member 17. The axes of the bore 49 and the shaft 51 are substantially coincident with the rotational axis 45.

The driving member 17 also has a stub shaft or driving cam 55 having an external surface or driving cam surface 57 which is cylindrical about a first inclined axis 59 which is inclined relative to the rotational axis 45 to provide a first, fixed offset angle 61. Although the magnitude of the offset angle 61 can be varied depending upon the results desired, in this embodiment it is 2 degrees.

The driving member 17 also has an annular flange 63 which projects radially outwardly of both the hub 47 and the shaft 55 intermediate the hub and the shaft. The driving member 17 may be constructed of any suitable material, such as a metal.

The driven member 21 is mounted on the driving member 17 for rotation relative to the driving member to thereby vary the relative angular position of the driving and driven members. The driven member 21 is also drivingly coupled to the wobble plate 26 by the bearing 23.

More specifically, the driven member 21 has an internal surface 65 defining a bore 67 which receives the shaft 55 of the driving member 17. The surface 65 and the bore 67 are at least partially cylindrical, and in this embodiment, are cylindrical. The surface 65 and the bore 67 have axes which are substantially coincident with each other and with the first inclined axis 59 when the driven member 21 is mounted on the shaft 55. The shaft 55 and the bore 67 cooperate to permit free relative rotation of the driving member 17 and the driven member 21 to thereby vary the relative angular position of these two members. The coupling 25, however, strongly influences the extent to which such relative angular position can change. Of course, the surfaces 57 and 65 may mount one or more bearings which in turn would rotatably mount the driven member 21 on the driving member 17.

The driven member 21 has a hub or driven cam 69 with an external surface or driven cam surface 71 on which the bearing 23 is press fit. The surface 71 is at least partially cylindrical and, in this embodiment, is fully cylindrical. The surface 71 is cylindrical about a second, fixed inclined axis 73 which is inclined at a second offset angle 75 relative to the axis 59. Although the offset angle 75 could have various different magnitudes, in this embodiment, it is two degrees. Also, by making the offset angles 61 and 75 equal, the wobble plate 26 may, under certain operating conditions, have a total wobble plate angle of 0 degrees in which the pump 11 will deliver no fluid.

The wobble plate 26 is attached to the outer race of the bearing 23 in any suitable manner, such as by a press fit. Accordingly, the wobble plate 26 and the bearing 23 will lie in a plane whose angle is controlled by the relative angular positions of the members 17 and 21. If desired, the bearing 23 may be considered as part of the wobble plate. The wobble plate 26 is also joined to the diaphragm 35 by the clamping members 37 and 39 and the fastener 41 so that it is held against rotation and will nutate to stroke the associated region of the diaphragm.

To minimize movement of the diaphragm 35 at its central region, the axes 45, 59 and 73 preferably intersect at a point 77 at the center of the diaphragm 35. The nutation of the wobble plate 26 occurs about the point 77. The coupling 25 comprises a preloaded clock spring 79 (FIGS. 1 and 5) which is wound on a flange 81 of the driven member 21. The flange 81 is polygonal as viewed in cross section (FIG. 5) and, as such, comprises a series of intersecting flats 83. In this embodiment, the flange 81 is octagonal in cross section.

An inner end 85 of the spring 79 is attached to the flange 81 of the driven member 21 in any suitable manner, such as by inserting the inner end portion 85 into a corresponding recess 87 (FIG. 5) in the flange where it is retained by the resilience of the spring 79. An outer end portion 89 of the spring 79 is attached to the driving member 17 in any suitable manner, such as by wrapping the outer end portion 89 of the spring about a pin 91 carried by the flange 63.

The coupling 25 also includes a disc 93 between the spring 79 and the ball bearing 23 (FIG. 1). The disc 93 has an octagonal hole 95 to enable it to be mounted on the flange 81 of the driven member 21 in any of eight different angular positions. The disc 93 also includes a projection forming a stop 97.

Figure 2:
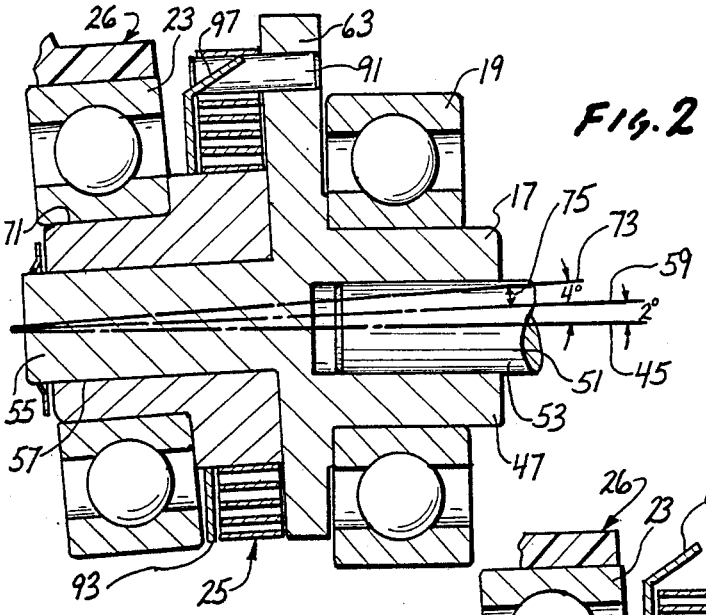
FIGS. 2–4 are fragmentary sectional views similar to a portion of FIG. 1 illustrating the effect of relative angular position of the driving and driven members on wobble plate angle.

When the pump 11 is not operating, the preloaded spring 79 biases the members 17 and 21 to provide a maximum 4-degree wobble plate angle. In operation, the shaft 51 of the motor 15 rotates the driving member 17 about the rotational axis 45. The driving member 17 rotates the driven member 23 through the coupling 25, and rotation of the surface 71 causes the usual nutating motion of the bearing 23 and the wobble plate 26 to thereby reciprocate the region of the diaphragm at the pumping chamber 43 to cause the pump 11 to pump a fluid medium, such as water, a beverage or beverage component. Because the spring 79 is preloaded, so long as the torque transmitted by the drive mechanism 13 is insufficient to overcome the preload, the relative angular position of the driven member 21 on the driving member 17 will be as shown in FIG. 2. FIG. 2 shows the driving member 17 and the driven member 21 rotated 180 degrees from the position of FIG. 1 to illustrate the nutation of the wobble plate 26. In FIG. 2, the two offset angles 61 and 75 are added together to provide a maximum wobble plate angle of, in this embodiment, 4 degrees.

Figure 3:
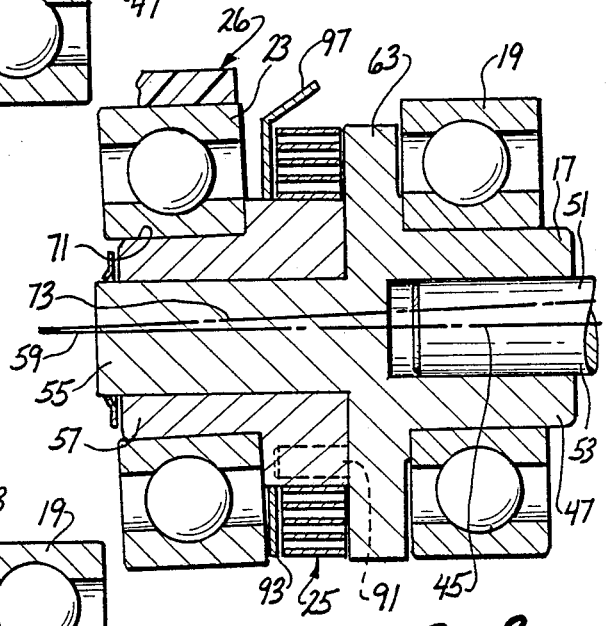

When the demand for liquid from the pump 11 reduces, the back pressure on the moving portion of the diaphragm 35 increases so that the drive mechanism 13 must transmit additional torque. Assuming that this torque is sufficient to overcome the preload of the spring 79, the spring 79 will be wound to increase the torque which the drive mechanism 13 can transmit and to reduce the wobble plate angle to thereby tend to reduce the flow rate. This is illustrated by way of example in FIG. 3 where some relative rotation, e.g. 120 degrees, between the driving member 17 and the driven member 21 has occurred so as to cause the two offset angles 61 and 75 to be combined to produce some intermediate value of wobble plate angle between 0 and 4 degrees, e.g., 2 degrees.

Figure 4:
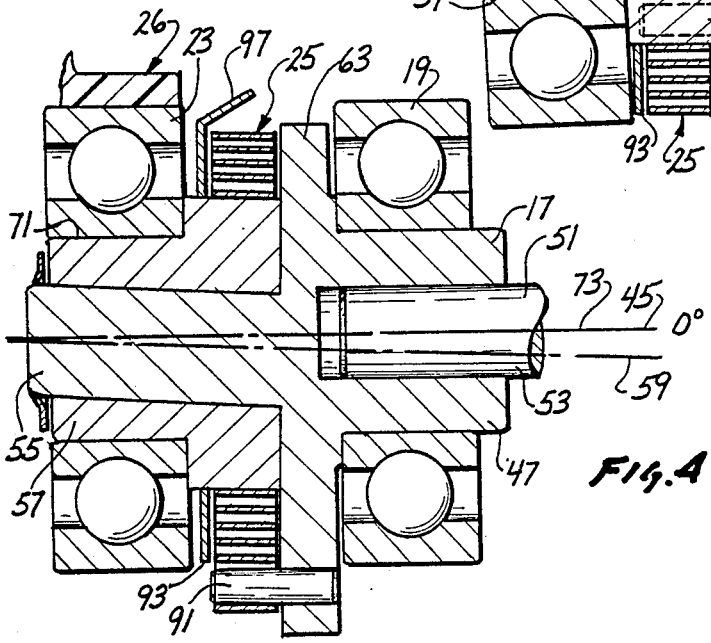
Figure 6:
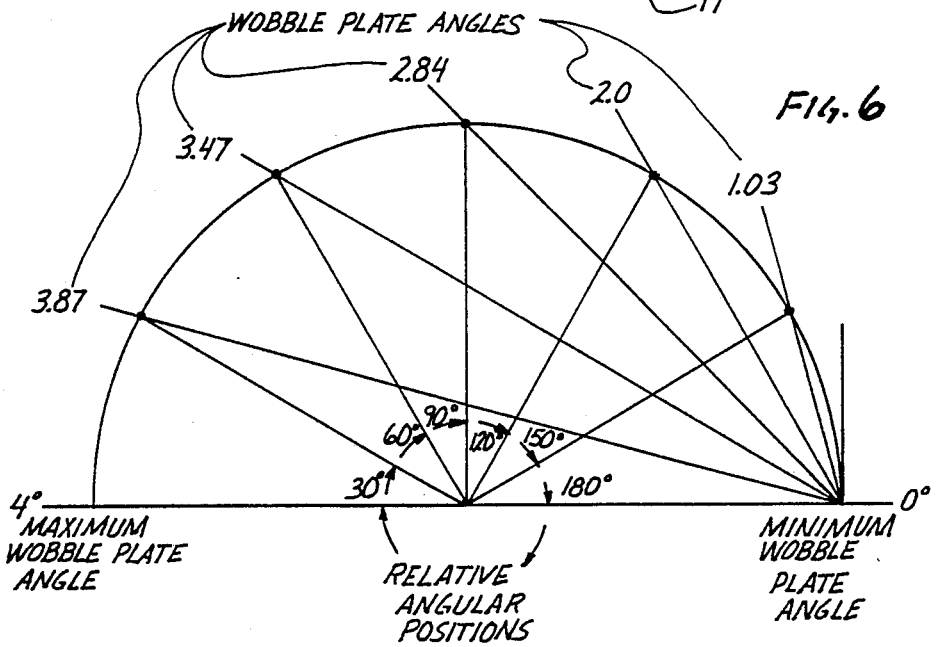
FIG. 6 is a diagram showing the relationship between relative angular position of the driving and driven members and wobble plate angle.

This summation is shown diagrammatically in FIG. 6 where it can be seen by way of example that a 30-degree change in relative angular position from the 4-degree position or maximum wobble plate angle produces a wobble plate angle of 3.87 degrees, and a 90-degree change of relative angular position from the 4-degree position reduces the total wobble plate angle to 2.84 degrees. Thus, the relationship between relative angular position of the members 17 and 21 and total wobble plate angle is nonlinear and is a cosecant function. Also, wobble plate angle is a function of the offset angles 61 and 75, which are fixed for any given drive mechanism 13 and the relative angular position of the driving and driven members 17 and 21. FIG. 6 also illustrates that at 180 degrees from the 4-degree position, the offset angles 61 and 75 totally offset each other so as to provide a minimum wobble plate angle of 0 degrees, and this is also illustrated in FIG. 4. The 0-degree position is shown by way of example in FIG. 4.

Figure 5:
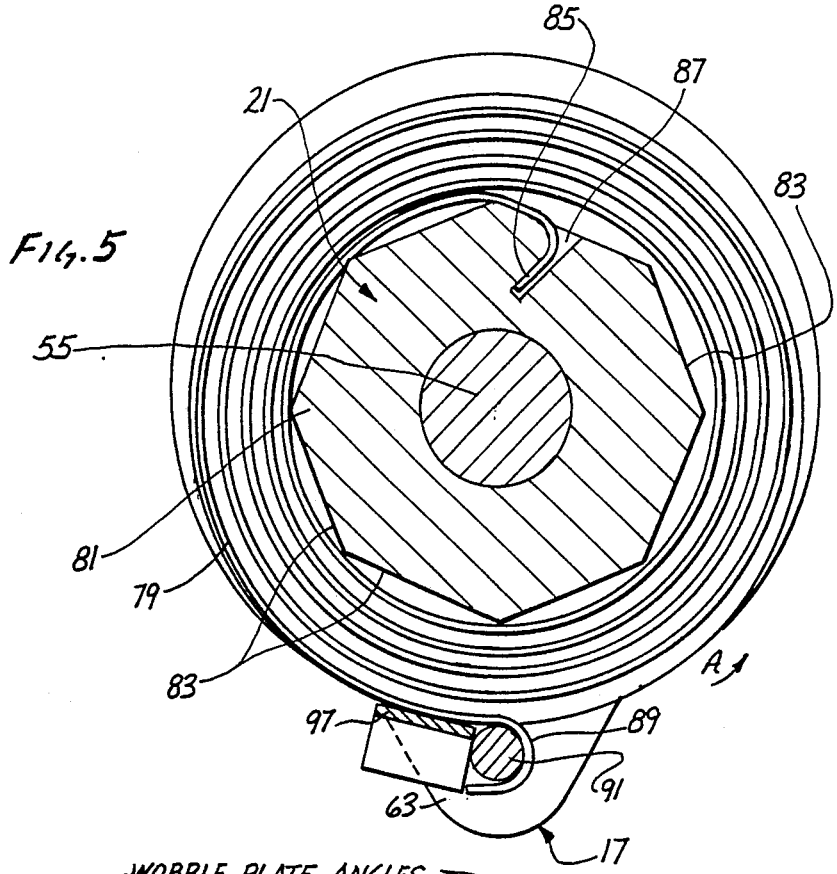
FIG. 5 is a sectional view taken generally along line 5—5 of FIG. 1.

The rotation of the driving member 17 is in the direction of the arrow A in FIG. 5 so as to tend to move the pin 91 counterclockwise away from the stop 97. By removing the disc 93 from the flange 81 and replacing it on the flange with the stop 97 in a position displaced counterclockwise from that shown in FIG. 5, the maximum wobble plate angle, or wobble plate angle, at the beginning of pump operation is reduced. By so doing, the wobble plate drive mechanism 13 will transmit higher torque, and the maximum displacement of the diaphragm 35 is reduced so that the maximum fluid delivery rate of the pump is reduced.

Although an exemplary embodiment of the invention has been shown and described, many changes, modifications and substitutions may be made by one having ordinary skill in the art without necessarily departing from the spirit and scope of this invention.

I claim:

1. An apparatus for moving a fluid medium and adapted to be driven by a motor, said apparatus comprising:

a positive displacement member movable on intake and discharge strokes to move the fluid medium;

a wobble plate coupled to the positive displacement member with the wobble plate having an angle which influences the length of said strokes and the volume of the fluid medium moved by the positive displacement member;

rotatable driving member rotatable about a rotational axis and adapted to be driven by the motor about a rotational axis;

a rotatable driven member mounted on the driving member for rotation relative to the driving member about a driven member axis which is eccentric to said rotational axis to thereby vary the relative angular position of the driving and driven members, said driven member being drivingly coupled to said wobble plate;

means including said rotational axis and said driven member axis for adjusting the angle of the wobble plate as a function of the relative angular position of the driving and driven members; and a resilient torque transmitting coupling for coupling the driving member to the driven member so that rotation of the driving member drives the driven member and the relative angular position of the driving and driven members about said rotational axis and said driven member axis and the wobble plate angle are related to the torque transmitted by the torque transmitting coupling.

2. An apparatus as defined in claim 1 including means for adjusting the maximum wobble plate angle.

3. An apparatus as defined in claim 1 wherein the torque transmitting coupling is preloaded whereby the torque transmitting coupling can transmit a predetermined magnitude of torque without permitting a change in said relative angular position and in the wobble plate angle.

4. An apparatus as defined in claim 3 including means for adjusting the preload on the torque transmitting coupling.

5. An apparatus as defined in claim 3 wherein the torque transmitting coupling includes a spirally wound spring coupled at its opposite end portions to the driving and driven members, respectively.

6. An apparatus as defined in claim 1 wherein the said adjusting means includes means for mounting the driven member on the driving member for rotation about said first inclined axis is inclined relative to the driven membr axis is a first inclined axis rotational axis to form a first offset angle and means for mounting the wobble plate on the driven member about a second inclined axis which is inclined relative to the first inclined axis to form a second offset angle with said offset angles combining to form said wobble plate angle.

7. An apparatus as defined in claim 6 including an adjustable stop for controlling the relative angular position of said members and being adjustable to limit the maximum wobble plate angle to less than the sum of the offset angles.

8. An apparatus as defined in claim 6 wherein the means for mounting the driven member includes a first surface on the driving member on which the driven member is mounted for rotation, said first surface having said first inclined axis and said means for mounting the wobble plate includes a second surface on the driven member on which the wobble plate is mounted, said second surface having said second inclined axis.

9. An apparatus as defined in claim 8 wherein said first and second surfaces are external surfaces and are at least partially cylindrical about said first and second axes, respectively, and said means for mounting the driven member includes an internal surface which is at least partially cylindrical defining a bore which receives said first cylindrical surface of the driving member, and said bore has an axis which is substantially coincident with said first inclined axis when the bore receives said first surface.

10. An apparatus as defined in claim 9 wherein the driving member includes a hub having a bore with an axis and including bearing means for mounting the driving member for rotation about the rotational axis with the rotational axis being substantially coincident with the axis of the bore of the hub.

11. An apparatus comprising:

a driving member having means for mounting the driving member for rotation about a rotational axis;

a driven member;

means for mounting the driven member on the driving member for rotation about a first inclined axis which is inclined relative to the rotational axis to form a first offset angle;

a wobble plate drivingly coupled to said driven member;

means for mounting the wobble plate on the driven member about a second inclined axis which is inclined relative to the first inclined axis to form a second offset angle with said offset angles combining to form a wobble plate angle; and a resilient torque transmitting coupling for coupling the driving member to the driven member so that rotation of the driving member drives the driven member and the wobble plate.

12. An apparatus as defined in claim 11 wherein the means for mounting the driven member includes a first surface on the driving member on which the driven member is mounted for rotation, said first surface having said first inclined axis and said means for mounting the wobble plate includes a second surface on the driven member on which the wobble plate is mounted, said second surface having said second inclined axis.

13. An apparatus as defined in claim 12 wherein said first and second surfaces are external surfaces and are at least partially cylindrical about said first and second axes, respectively, and said means for mounting the driven member includes an internal surface which is at least partially cylindrical defining a bore which receives said first cylindrical surface of the driving member, and said bore has an axis which is substantially coincident with said first inclined axis when the bore receives said first surface.

14. An apparatus as defined in claim 13 wherein the driving member includes a hub having a bore with an axis and including bearing means for mounting the driving member for rotation about the rotational axis with the rotational axis being substantially coincident with the axis of the bore of the hub.

* * * * *

UNITED STATES PATENT AND TRADEMARK OFFICE

CERTIFICATE OF CORRECTION

PATENT NO. : 4,797,069

DATED : January 10, 1989

INVENTOR(S) : E. Dale Hartley, F. Scott Hartley

It is certified that error appears in the above-identified patent and that said Letters Patent is hereby corrected as shown below:

Column 7, line 11 after "the" insert -- driven member axis is a first inclined axis,--.

Column 7, line 14 after "axis" insert -- , said first inclined axis --.

Column 7, lines 14 and 15 delete "driven membr axis is a first inclined axis".

Signed and Sealed this

Eleventh Day of July, 1989

*Attest:*

*Attesting Officer*

DONALD J. QUIGG

*Commissioner of Patents and Trademarks*